United States Patent [19]

Bull et al.

[11] Patent Number: 4,535,674

[45] Date of Patent: Aug. 20, 1985

[54] APPARATUS FOR CONTROL OF MOVING STRANDS FROM ROTATING STRAND SUPPLY BOBBINS

[75] Inventors: Jeffrey F. Bull, Akron; Harlan Johnson, Copley, both of Ohio; James F. Karg, 4550 Shaw Rd. Ext., Akron, Ohio 44313; Michael E. Winiasz, Lorain, Ohio

[73] Assignee: James F. Karg, Akron, Ohio

[21] Appl. No.: 673,384

[22] Filed: Nov. 20, 1984

[51] Int. Cl.[3] ..... D04C 3/40; D04C 3/42

[52] U.S. Cl. ..... 87/29; 87/33; 87/44; 87/48

[58] Field of Search ..... 87/6, 8, 29, 30, 32, 87/33, 37, 38, 44–48

[56] References Cited

U.S. PATENT DOCUMENTS

| | | | |
|---|---|---|---|
| 447,262 | 2/1891 | Tregurtha | 87/47 X |
| 814,711 | 3/1906 | Larsson | 87/45 |
| 851,204 | 4/1907 | Parks et al. | 87/46 |
| 1,058,100 | 4/1913 | Rankin | 87/46 |
| 1,516,568 | 11/1924 | Horn | 87/48 |
| 1,689,389 | 10/1928 | Horn | 87/48 |
| 1,704,888 | 3/1929 | Frederickson | 87/32 |
| 1,864,249 | 6/1932 | Horn | 87/45 |
| 1,955,206 | 4/1934 | Standish | 87/47 |
| 2,464,899 | 3/1949 | Sokol | 87/48 |
| 3,834,271 | 9/1974 | Hinds et al. | 87/46 |
| 3,892,161 | 7/1975 | Sokol | 87/29 |
| 4,034,642 | 7/1977 | Iannucci et al. | 87/48 |
| 4,034,643 | 7/1977 | Iannucci et al. | 87/48 |
| 4,130,046 | 12/1978 | Sokol | 87/48 |
| 4,275,638 | 6/1981 | De Young | 87/29 X |
| 4,304,169 | 12/1981 | Cimprich et al. | 87/29 |
| 4,372,191 | 2/1983 | Iannucci et al. | 87/48 |

*Primary Examiner*—John Petrakes

*Attorney, Agent, or Firm*—Mack D. Cook, II

[57] ABSTRACT

Apparatus for the control of relative strand movement, without significantly affecting or altering strand tension, on a braiding machine with two sets of carriers for a strand supply bobbin being rotated in opposite directions and being generally axially aligned, as a set of front and rear strand carriers and supply bobbins. A set of rear strands pass through peripheral and radially arcuate slots in a carrier mounting table and are guided prior to movement into the slot by a set of cam actuated swing arms movable in a common plane perpendicular to the machine axis. The rear strands move through an arc segment relative to the machine axis for interweaving with a set of front strands. The interwoven rear and front strands are led to a circular ring at the front of the machine having an effective diameter coincident with the rotational axis of the front bobbins. The interwoven strands are then pulled from the machine to a "work center" for tight braiding around a core or mandrel.

8 Claims, 8 Drawing Figures

APPARATUS FOR CONTROL OF MOVING STRANDS FROM ROTATING STRAND SUPPLY BOBBINS

BACKGROUND OF THE INVENTION

The invention relates generally to an improved strand fabricating machine; also known in the art as a braiding machine.

More specifically, the invention relates to an apparatus for the control of moving strands from rotating strand supply bobbins.

Still further, the invention relates to the control of relative strand movement, without significantly affecting or altering strand tension, on a braiding machine with two sets of carriers for a strand supply bobbin being rotated in opposite directions and being generally axially aligned, as a set of front and rear strand carriers and supply bobbins. The multiple sets of contra-rotating front and rear strands are let-off from the supply bobbins under controlled tension. The moving sets of strands are interwoven, rear strands over and around front strands, by guiding of the rear strands through an arc segment relative to the central axis of the braiding machine. The arcuate movement does not change or substantially alter rear strand length thereby maintaining strand tension. The tensioned interwoven sets of strands are led to and around a circular ring in front of the front bobbins which has an effective diameter coincident with the rotational axis of the front bobbins. The circular ring may be rotated in the same direction as the moving set of strands from the rear supply bobbins to eliminate any rotational friction or "drag back" of the rear strands. Then, the interwoven strands are pulled from the braiding machine to a "work center" for tight braiding around a core or mandrel moving along the central axis of the machine.

In the prior art, the use of positively actuated lever or arm means for interweaving sets of moving strands between the braiding point and sets of contra-rotating strand supply bobbins is disclosed in: U.S. Pat. No. 447,262, 1891, Tregurtha, et al; U.S. Pat. No. 814,711, 1906, Larsson; U.S. Pat. No. 1,516,568, 1924, Horn; U.S. Pat. No. 1,689,389, 1928, Horn; U.S. Pat. No. 1,864,249, 1932, Horn; U.S. Pat. No. 1,955,206, 1934, Standish; U.S. Pat. No. 3,834,271, 1974, Hinds, et al; U.S. Pat. No. 3,892,161, 1975, Sokol; U.S. Pat. No. 4,034,642, 1977, Iannucci, et al; and, U.S. Pat. No. 4,372,191, 1983, Iannucci, et al.

In the prior art, the use of axially located circular rings for peripheral and guiding engagement with moving strands from contra-rotating sets of upper-lower strand supply bobbins is disclosed in: U.S. Pat. No. 814,711, 1906, Larsson; U.S. Pat. No. 851,204, 1907, Parks & Wardwell; and, U.S. Pat. No. 1,704,888, 1929, Frederickson.

So far is is known to the inventors, the most relevant prior art patent is U.S. Pat. No. 814,711, 1906, Larsson. This patent discloses a braiding machine having a set of lower carriers G for a strand supply bobbin 1 mounted on an annular body D for rotation in one direction. A set of upper carriers L for a strand supply bobbin 2 are movable around the upper side of the annular body D in a raceway H. The upper carriers L are rotated in an opposite direction to the lower carriers G by a series of spur pinions m interconnecting rack-teeth j on bases i for the carriers L with a large spur gear-wheel d. The gear-wheel is rotated around a standard A by a power shaft B through a spur-pinion f which meshes with a spur gear-wheel C, which carries the gear wheel-d. The carriers, L and G, are generally axially aligned so that the orbits or paths of movements of the lower and upper sets of bobbins, 1 and 2, "are of about equal diameter." (page 2, col. 1, 11. 31–34)

The apparatus according to the invention is used with a braiding machine having a set of rear carriers mounted on the rear side of a first table for rotation in one direction, and a set of front carriers mounted on and driven around the front side of the first table, by rotation of a second table in front of the first table, in the opposite direction. This braiding machine also has a central axis stationary shaft for rotatable mounting of the first and second tables thereon.

In Larsson, the annular body D has a set of peripheral radial slots v which intersect the raceway H for the upper carriers L. In the apparatus according to the invention, the first table has a set of peripheral and radially arcuate slots.

In Larsson, the set of moving strands from the lower bobbins 1 pass through a set of elongated guides or carriers J positioned within the radial slots v in the annular body D and mounted for swinging movements in vertical planes radial to the axis of the braiding machine. In the apparatus according to the invention, the set of moving strands from the rear bobbins is guided by a set of swing arms movable in a common plane perpendicular to the axis of the braiding machine. Each swing arm is carried on the first table between two of the radially arcuate slots and has an eyelet engaging a rear strand prior to movement thereof into a first table radially arcuate slot. The rear strands are guided through an arc segment relative to the central axis of the braiding machine, by the movement of the swing arms perpendicular to the braiding machine axis.

In Larsson, the pivotally mounted thread-carriers or strand guides J are actuated by a set of rotating cams p "formed with two concentric portions and two working portions, so there will be 'dwells' in the motions of the thread carrier while it is in its inward and its outward positions, and the abruptness of the working portions are such that the thread-carrier will be swung in the radial slot v, which intersects the raceway for the upper set of bobbin-carriers between the times when such carriers reach and are passing across said slots, also the thread-carriers and the upper set of bobbin-carriers with their bobbins, will dodge each other at the said slotted portions v of the annular part D." (page 3, col. 1, 11. 51–64)

In Larsson, the lobed cams p for swinging movement of the strand guide J are driven by a spur-pinion r carried by a shaft q which meshes with a small pinion u carried by an axis-shaft $m^2$ carried by every other one of the pinions m driven by the large spurgear-wheel d.

In the apparatus according to the invention, the braiding machine has a control element positioned around the central axis stationary shaft and behind the rear side of the first table. The control element carries and positions a stationary cam track radially inwardly of a set of rear strand supply bobbins. The cam track has a set of alternating inner and outer portions providing a "dwell" in movement for all of the strand guiding mechanisms during rotation of the first table.

In Larsson, a circular ring formed by elements $kk^2k^3$ and termed as the "cap" is supported as an extension of the upstanding tubular portion a of the base or standard A. "As shown, the periphery of the thread-supporting cap is in substantial vertical alinement with the path of movement of the upper set of bobbins. By this construction all of the threads have a common support concentric to the point where the braid is formed." (page 2, col. 1, 11. 47–53). As understood by the inventors, the stationary circular braid ring of Larsson is intended to secure uniform braiding at the "work center", even though the set of moving strands from the lower bobbins 1 are being swung by the carriers J, back and forth or in and out, in vertical planes radial to the axis of the braiding machine. Larsson intends that the "cap lies in proximity to the bobbins, thereby forming a sharp angle between the threads when the thread-carriers are in their extremes of movements to prevent any liability of a tangle forming." (page 2, col. 1, 11. 64–65, col. 2, 11. 1–3)

In the apparatus according to the invention, a circular braid ring is mounted coaxially on the central axis stationary shaft in front of the second table and also has an outer diameter coincident with the axes of rotation of the front bobbins. The inventors intend that the circular braid ring function to extend the "braid point" of the braiding machine, as far as practical toward infinity. As shown by reference to drawing FIG. 6, the circular braid ring defines the forward apex of a conical envelope generated by the linear and arcuate movement of the rear tensioned strands so that uniform and concentric braiding with the linearly moving tensioned front stands will occur at the braid ring outer diameter. The braiding or interweaving of the strand sets is achieved within the parameters of the braiding machine and subsequent movement of the interwoven strands from the braiding machine to a "work center" is merely for tightening of an established braid configuration around a core or mandrel moving along the central axis of the machine.

SUMMARY OF THE INVENTION

It is an object of the invention to provide an improved strand fabricating machine.

It is a further object of the invention to provide an improved apparatus for the control of moving strands from rotating strand supply bobbins.

Still further, it is an object to provide an efficient, precise and relatively inexpensive apparatus for the control of relative strand movement, without significantly affecting or altering strand tension, on a braiding machine with two sets of carriers for a strand supply bobbin being rotated in opposite directions and being generally axially aligned, as a set of front and rear strand carriers and supply bobbins.

These and other objects of the invention, as well as the advantages thereof, will become apparent in view of the drawings and the detailed description.

The invention is used with a braiding machine having a set of rear carriers for a strand supply bobbin mounted on the rear side of a first table for rotation in one direction. The strands from a set of supply bobbins on the rear carriers pass through a set of peripheral slots in the first table. A second table is in front of the first table. A set of front carriers for a strand supply bobbin are mounted on and driven around the front side of the first table by rotation of the second table. The braiding machine also has a central axis stationary shaft for rotatable mounting of the first and second tables thereon. The braiding machine also has a drive mechanism for rotating the first and second tables in opposite directions.

An apparatus according to the invention for control of moving strands from the sets of supply bobbins on the rear and front carriers during movement thereof around and along the central axis stationary shaft and toward the "work center" of the braiding machine, has a set of first table peripheral slots which are radially arcuate for movement of a set of strands from the rear carriers through an arc segment relative to the axis of the stationary shaft. The apparatus further has a set of mechanisms carried on the rear side of the first table for guiding a set of strands from the rear carriers prior to movement thereof into the radially arcuate slots. Each of the rear strand guide mechanisms is between two of the radially arcuate slots. A variable radius cam track is selectively positioned behind the rear side of the first table and radially inwardly of the set of rear carriers. The cam track actuates and controls the set of rear strand guide mechanisms by rotation of the first table. A circular braid ring is mounted coaxially on the central axis stationary shaft in front of the second table. The braid ring has an outer diameter substantially coincident with the axes of rotation of a set of bobbins on the front carriers. The braid ring may be rotated in the same direction as the set of bobbins on the rear carriers and the first table.

Each of the rear strand guide mechanisms has an elongated rotatable swing arm movable in a common plane perpendicular to the axis of the central stationary shaft. Each swing arm has an eyelet for engaging a moving strand from one of the rear carrier supply bobbins behind the rear side of the first table.

The apparatus according to the invention may also have a set of strand guide components positioned behind the rear side of the first table at a point along the axis of rotation for the guide mechanism swing arms to receive moving strands from the rear carrier supply bobbins before the moving strands are engaged by the swing arm eyelets.

IN THE DRAWINGS

DETAILED DESCRIPTION OF THE INVENTION

Figure 1:
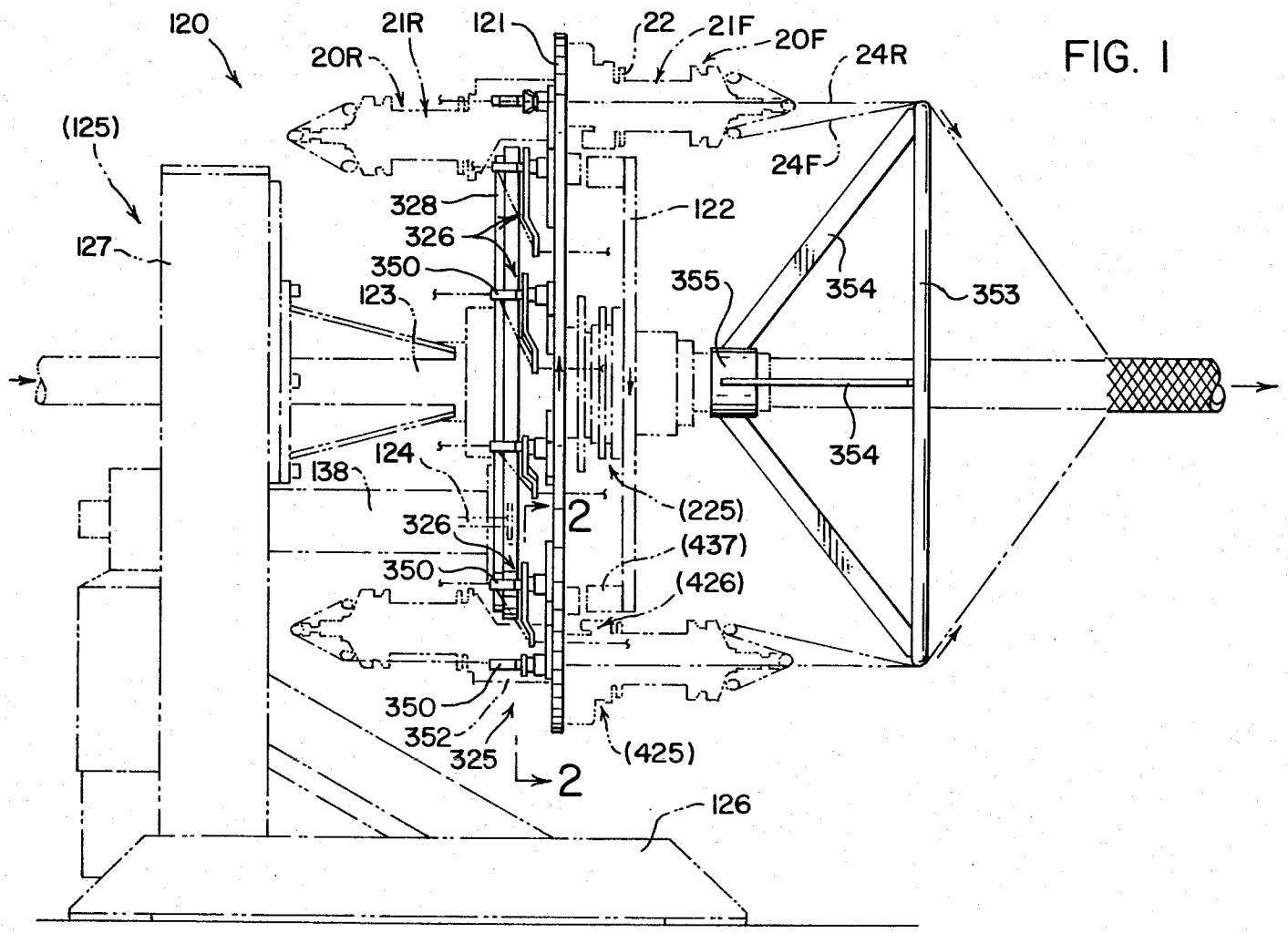
FIG. 1 is a side view of a braiding machine showing the apparatus for the control of moving strands from rotating strand supply bobbins in full lines, other components of the braiding machine being shown in chain lines.

A horizontal braiding machine, embodying the present invention, is referred to generally by the numeral 120. The braiding machine 120 will have a set of rear carriers 20R for a strand supply bobbin mounted on the rear side of a first table 121 for rotation in one direction. The braiding machine 120 will further have a set of front carriers 20F for a strand supply bobbin movable around the front side of the first table 121 for rotation by a second table 122 in the opposite direction. A stationary shaft 123 on the central axis of the braiding machine rotatably mounts the first table 121 and second table 122 thereon. A drive mechanism power input shaft 124 extends parallel to the stationary shaft 123 and toward the rear side of the first table 121.

The apparatus according to the invention, for control of moving strands from strand supply bobbins, 21R and 21F, on the contra-rotating sets of strand carriers, 20R and 20F, is referred to generally by the numeral 325. The strand guide apparatus components 325 are operable above a frame base 126 carrying a vertically oriented frame stanchion 127 for mounting the central axis stationary shaft 123 and the power input shaft 124.

Each set of carriers, 20R and 20F, and the strand supply bobbins, 21R and 21F, thereon, are shown only in chain lines. A moving length of strand material is indicated at 24R or 24F. A carrier 20 for a supply bobbin spool (22) particularly suited for use on a braiding machine 120 may be as disclosed in U.S. Patent Appln. Ser. No. 648,064, filed Sept. 7, 1984, Bull, et al, Carrier For A Strand Supply Bobbin. Reference is made to said patent application for such further details as may be required to more fully understand the nature of the invention.

A mounting for the stationary shaft 123 and the power input shaft 124 is shown only by chain lines. A mounting assembly (125) particularly suited for use on a braiding machine 120 may be as disclosed in U.S. Patent Appln. Ser. No. 673,382, filed Nov. 20, 1984, Bull, et al, Apparatus For Mounting Of Components For Rotation Of Carriers For A Strand Supply Bobbin And For Timing Strand Movement Relative To Rotation. Reference is made to said patent application for such further details as may be required to more fully understand the nature of the invention.

A drive mechanism for selectively rotating the first table 121 and the second table 122 in opposite directions around the stationary shaft 123, in response to rotation of the power input shaft 124, is shown only by chain lines. A drive mechanism (225) particularly suited for use on a braiding machine 120 may be as disclosed in U.S. Patent Appln. Ser. No. 673,383, filed Nov. 20, 1984, Winiasz, Apparatus For Rotation Of Carriers For A Strand Supply Bobbin. Reference is made to said patent application for such further details as may be required to more fully understand the nature of the invention.

Apparatus for mounting the front strand carriers 20F on the front side of the first table 121 is shown only by chain lines. A drive assembly for moving each front strand carrier 20F during rotation of the second table 122 is also shown only by chain lines. A front strand carrier mounting and drive assembly (425) particularly suited for use on a braiding machine 120 may be as disclosed in U.S. Patent Appln. Ser. No. 673,385, filed Nov. 20, 1984, Bull, et al, Apparatus For Rotating A Set Of Carriers For A Strand Supply Bobbin Relative To Moving Strands From A Set Of Contra-Rotating Carriers For A Strand Supply Bobbin. The disclosed front strand carrier mounting shuttles (426) and shuttle drive assemblies (437) function during operation of a braiding machine 120 so that moving strands 24R from the set of rear bobbins 21R will pass by the moving strands 24F from the set of front bobbins 21F and will not be contacted by the contra-rotating front strand carriers 20F. Reference is made to said patent application for such further details as may be required to more fully understand the nature of the invention.

The strand control apparatus 325 includes a set of mechanisms, indicated at 326, for guiding moving strands 24R from the set of rear bobbins 21R through an arc segment relative to the central axis of the braiding machine 120. The rear set of bobbin strands 24R pass through a set of peripheral and radially arcuate slots 327 in the first table 121 which are positioned between the guide mechanisms 326. The rear strands 24R are guided by the mechanisms 326, prior to movement into the arcuate slots 327, over and around moving strands 24F from the set of front bobbins 21F.

A control element 328 is adjustably positioned, as by secure connection to the front end of a drive torque tube 138 of an apparatus 125, coaxially around the central axis stationary shaft 123 behind the rear side of the first table 121. The element 328 carries and selectively positions a variable radius cam track 329 radially inwardly of the set of rear carriers 20R. The cam track 329 actuates and controls the set of strand guide mechanisms 326 during rotation of the first table 121. The cam track 329 has a set of alternating inner and outer portions, 329I and 329O, providing a "dwell" for the movement of the strand guiding mechanisms 326 at the radially outer and radially inner ends of the arcuate first table slots 327. The cam track dwell portions 329I and 329O are connected by a ramp or transition portion 329T.

A strand guiding mechanism 326 has a base plate 330 attached to the rear side of the first table 121, between any two of the radially arcuate slots 327, as by bolts 331. A base plate 330 carries a radially inner drive plate pin 332 and a radially outer swing arm pin 333 oriented parallel to the central axis of the braiding machine 120.

A strand guiding mechanism 326 also has a generally triangularly shaped drive plate indicated at 334. The drive plate base corner 335 is carried by the inner pin 332 and freely rotates on roller bearing assemblies 336. The drive plate apex corner 337 carries a rearwardly projecting cam follower 338 for confined engagement within the stationary cam track 329. The drive plate terminal corner 339 is connected to the base ends of dual connector means or links 340 by a pivot pin 341.

A strand guiding mechanism 326 further has an elongated rotatable swing arm indicated at 342. The swing arm base end 343 is carried by the pin 333 and freely rotates on roller bearing assemblies 344. The swing arm terminal end 345 carries an eyelet 346 for engaging a moving strand 24R from a rear bobbin 21R prior to movement thereof into a first table radially arcuate slot 327. The swing arm base end has an integral crank arm 347 connected to the terminal end of the dual connector links 340 by a pivot pin 348. The rear strands 24R are guided through an arc segment relative to the axis of the braiding machine 120, by movement of the swing arms 342 behind the first table 121, in a common plane perpendicular to the braiding machine axis during rotation of the first table 121.

The strand control apparatus 325 may further have a set of strand guide components positioned behind the rear side of the first table 121 and at a point along the axis of rotation for the swing arm 342 to receive a moving strand 24R from a rear bobbin 21R, before the moving strand 24R is engaged by the swing arm eyelet 346. As shown, the outer or base plate swing arm pin 333 has an extension 349 for mounting a strand guiding eyelet holder 350. The rearwardly projecting eyelet holder 350 establishes an optimum center point for a moving strand 24R from a rear bobbin 21R, irrespective of the actual point at which a strand 24R leaves a bobbin 21R. A centered rear strand 24R exits the eyelet holder 350 by a way of a side slot 351 and moves toward the swing arm terminal end 345. A set of eyelet holders 350 will establish and maintain an effective diameter of a set of moving strands 24R from a set of rear bobbins 21R coincident with the diameter of the axes of rotation of the front bobbins 21F.

In an alternative embodiment (not shown) a set of eyelet holders 350 could be carried on a stand 352 used to mount the carriers for the rear bobbins 21R on the rear side of the first table 121.

A strand control apparatus 325 for a braiding machine 120 may have a stationary braid ring, indicated at 353, positioned parallel to and in front of the set of front bobbins 21F and the second table 122. The braid ring 353 has an outer diameter coincident with the diameter of the axes of rotation of the front bobbins 21F, and with the effective diameter of a set of moving strands 24R from a set of rear bobbins 21R as established by the eyelet holders 350. All of the moving strands, 24R and 24F, are engaged with or bear upon the ring 353 prior to being pulled at the desired braid angle to the "work center" for tight braiding around a core or mandrel moving along the central axis of the braiding machine 120. As shown, a ring 353 is carried by a plurality of spoke shafts 354 extending outwardly from a hub 355 suitably secured to the central axis stationary shaft 123 forwardly of the second table 122.

Figure 5:
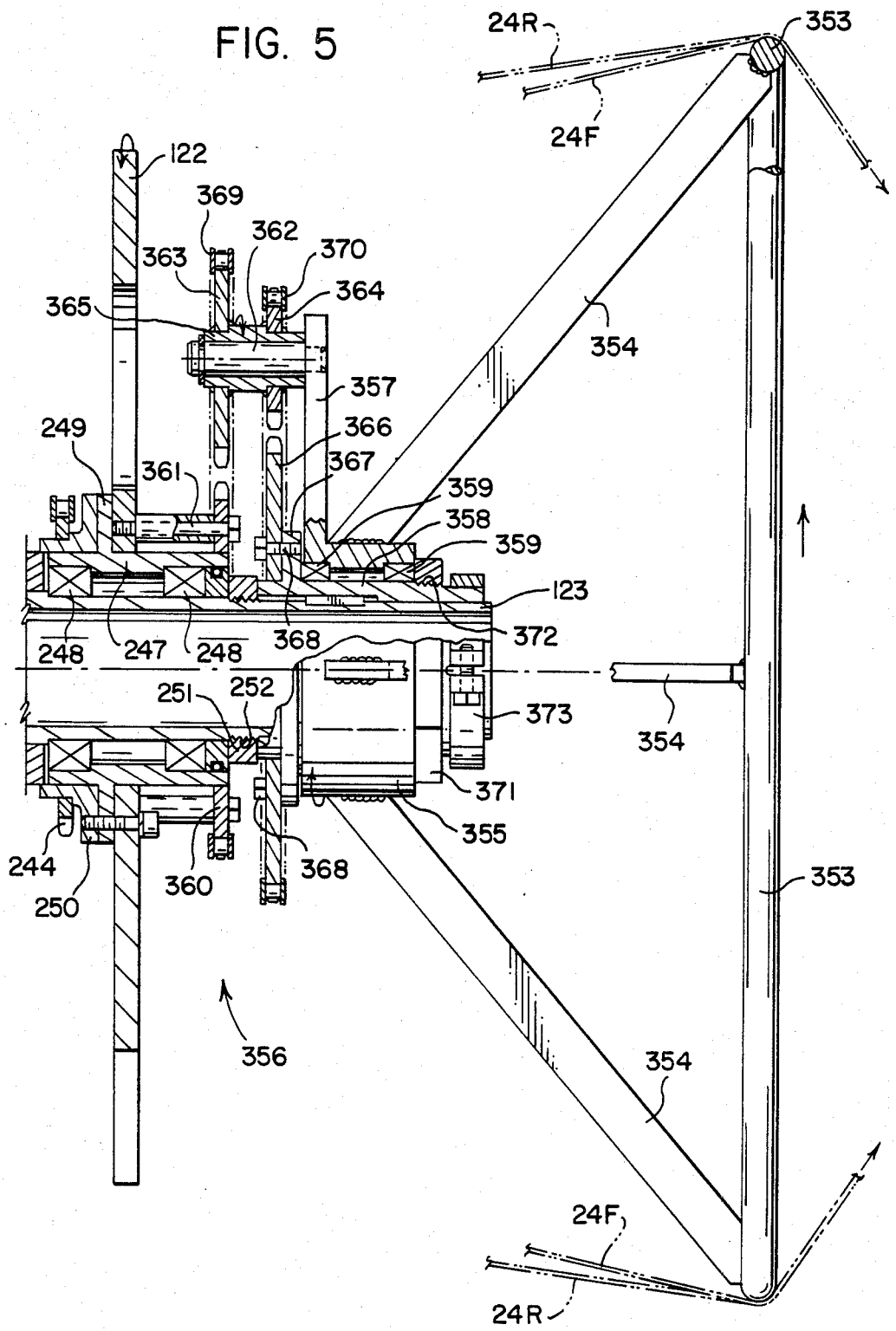
FIG. 5 is a side view, in section, showing details of the apparatus and a drive mechanism for rotating a braid ring around a central axis stationary shaft of the braiding machine.

A strand control apparatus 325 for a braiding machine 120 may also have a rotating braid ring 353, as shown in FIG. 5. An additional drive mechanism, indicated at 356, will rotate the braid ring 353, in the same direction, and preferably at the same speed, as the rear strand supply bobbins 21R being carried by the first table 121. Rotation of the braid ring 353 will substantially eliminate contact of the moving rear bobbin strands 24R with the edges of the peripheral and radially arcuate slots 327 in the first table 121 and prevent "drag back" of all of the moving strands, 24R and 24F, during passage over the ring 353.

The braid ring drive mechanism 356 includes a lateral arm 357 secured to or formed integrally with the braid ring hub 355. The hub 355 and lateral arm 357 are rotatably mounted on the central axis stationary shaft 123. As shown, a journal sleeve 358 is coupled or keyed to the stationary shaft 123. The hub 355 and lateral arm 357 freely rotate around the journal sleeve 358 on roller bearing assemblies 359.

As referenced above, the braiding machine 120 has a drive mechanism (225) for rotating the first table 121 and the second table 122 in opposite directions around the central axis stationary shaft 123. A drive mechanism (225) has a second journal sleeve 247 freely rotating on roller bearing assemblies 248. The journal sleeve 247 is secured around the stationary shaft 123 by a bearing nut 251 having internal threads for mating engagement with external threads 252 on the stationary shaft 123. The face of the journal sleeve 247 has an annular shoulder flange 249 for secure connection thereto of the second table 122 and a ring flange 250 carrying a drive mechanism sixth sprocket 244. The braid ring drive mechanism 356 has a first sprocket 360 positioned around the journal sleeve 247 and inwardly of the bearing nut 251 and securely connected to the second table 122 by spacer bolts 361.

The drive mechanism 356 further has a post shaft 362 extending from the rear side of the lateral arm 357 and substantially parallel to the central axis stationary shaft 123 and toward the second table 122. A second sprocket 363 aligned with the first sprocket 360 is positioned coaxially around the outer end of the post shaft 362 and rotatable thereon. A third sprocket 364 is positioned coaxially around the post shaft 362 on the medial portion thereof and rotatable thereon. The second sprocket 363 and the third sprocket 364 are coupled together, as by mounting on a journal bushing 365 carried by the post shaft 362.

The drive mechanism 356 further has a fourth or "sun" sprocket 366 positioned coaxially around the central axis stationary shaft 123 and coupled thereto and aligned with the third sprocket 364. As shown, rearward face of the journal sleeve 358 has an annular shoulder flange 367 for rotatably seating the hub 355 and lateral arm 357 and for secure connection thereto of the fourth sprocket 366, as by bolts 368.

A first chain means 369 connects the first sprocket 360 with the second sprocket 363. A second chain means 370 connects the third sprocket 364 with the fourth sprocket 366. During rotation of the second table 122 in one direction, the braid ring 363 will be rotated in the opposite direction by the drive mechanism 356.

The hub 355 and the lateral arm 357 are positioned in seated and rotatable engagement with the sleeve shoulder flange 367 by a bearing nut 371 having internal threads for mating engagement with external threads 372 on the journal sleeve 358. The journal sleeve 358 is secured around the central axis stationary shaft 123 by a clamp collar 373.

Figure 2:
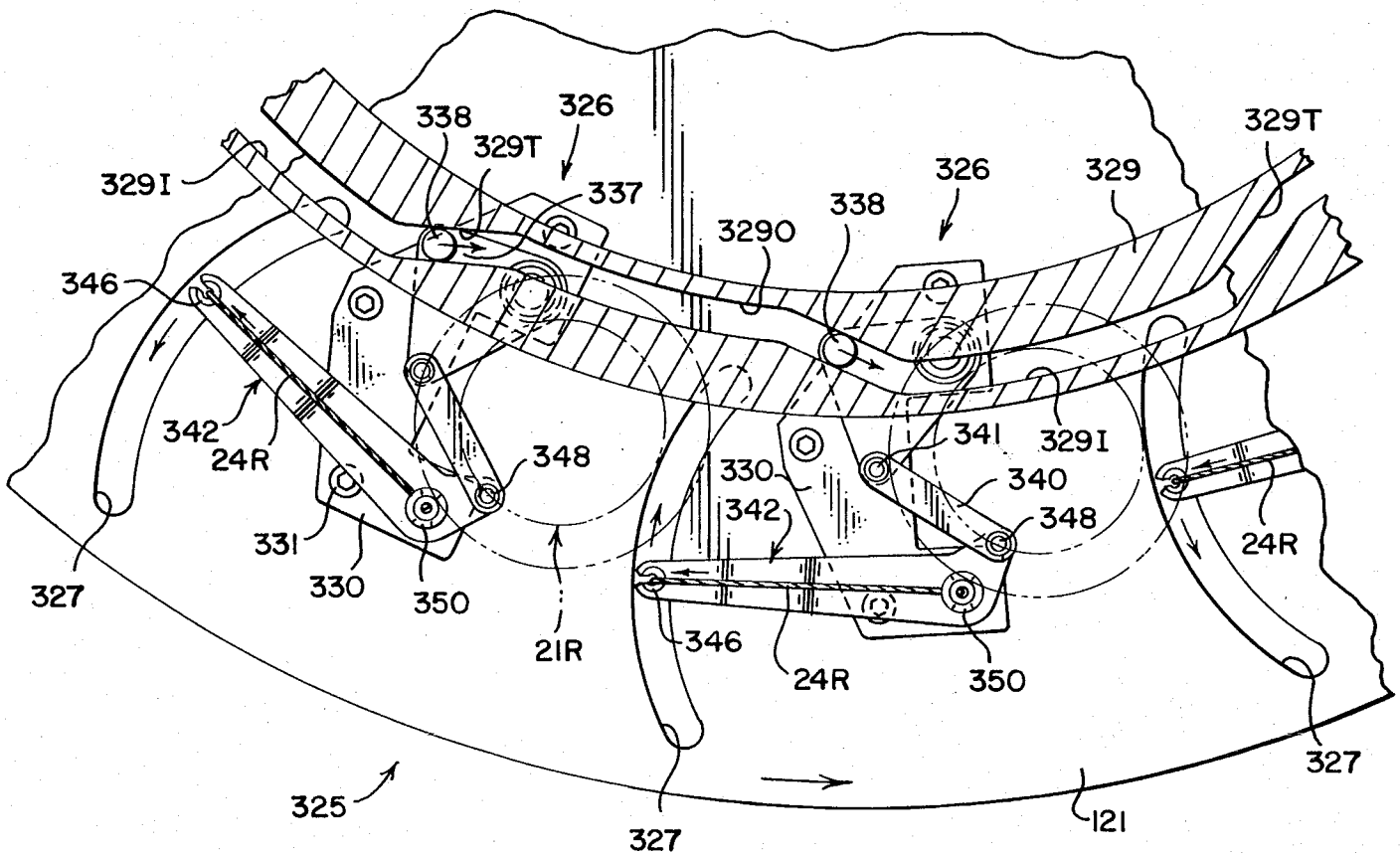
FIG. 2 is an enlarged fragmentary rear section, looking toward the front of the braiding machine, taken substantially as indicated on line 2—2 of FIG. 1.
Figure 3:
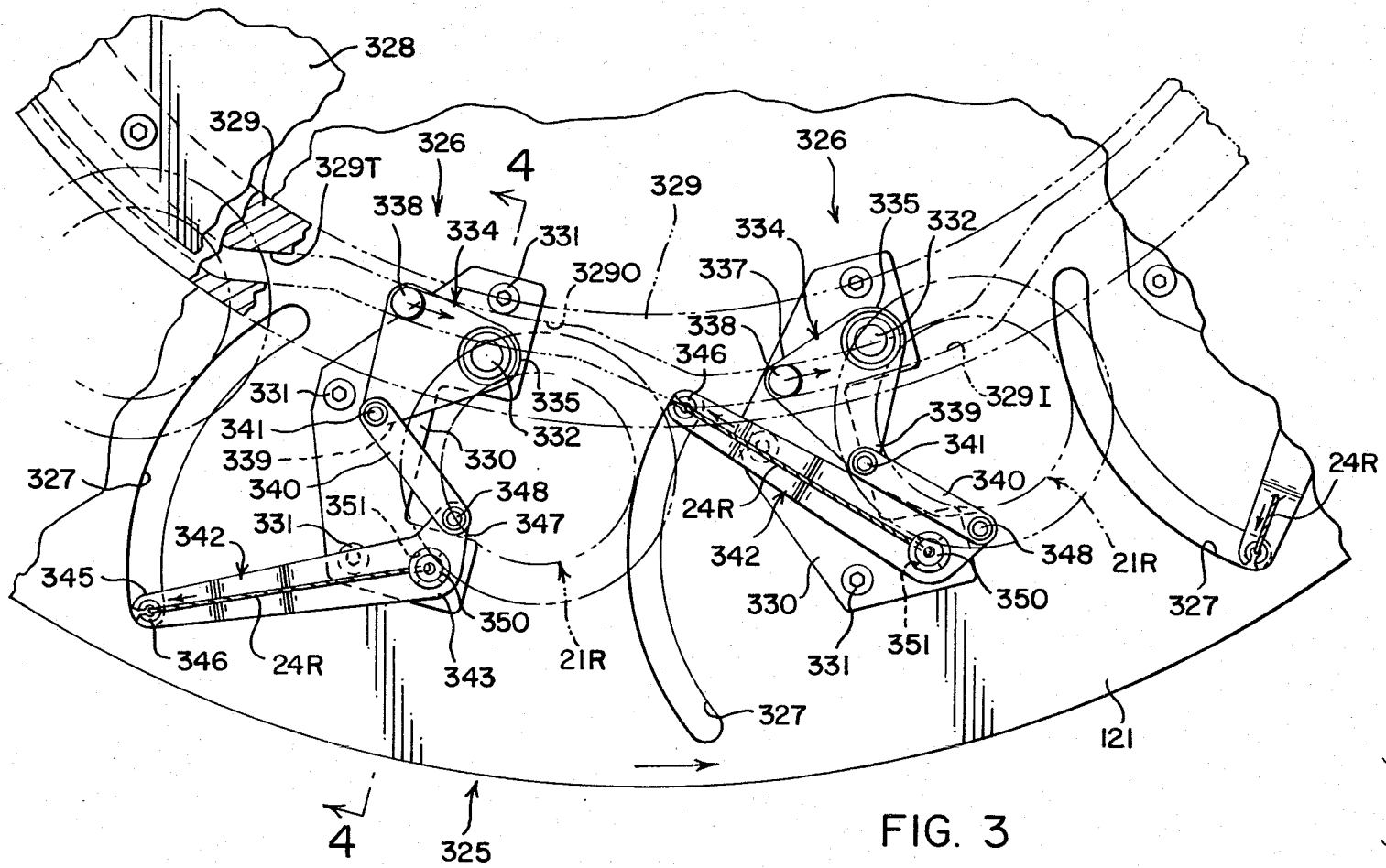
FIG. 3 is a related fragmentary rear section, taken in front of and following sequentially after FIG. 2.
Figure 4:
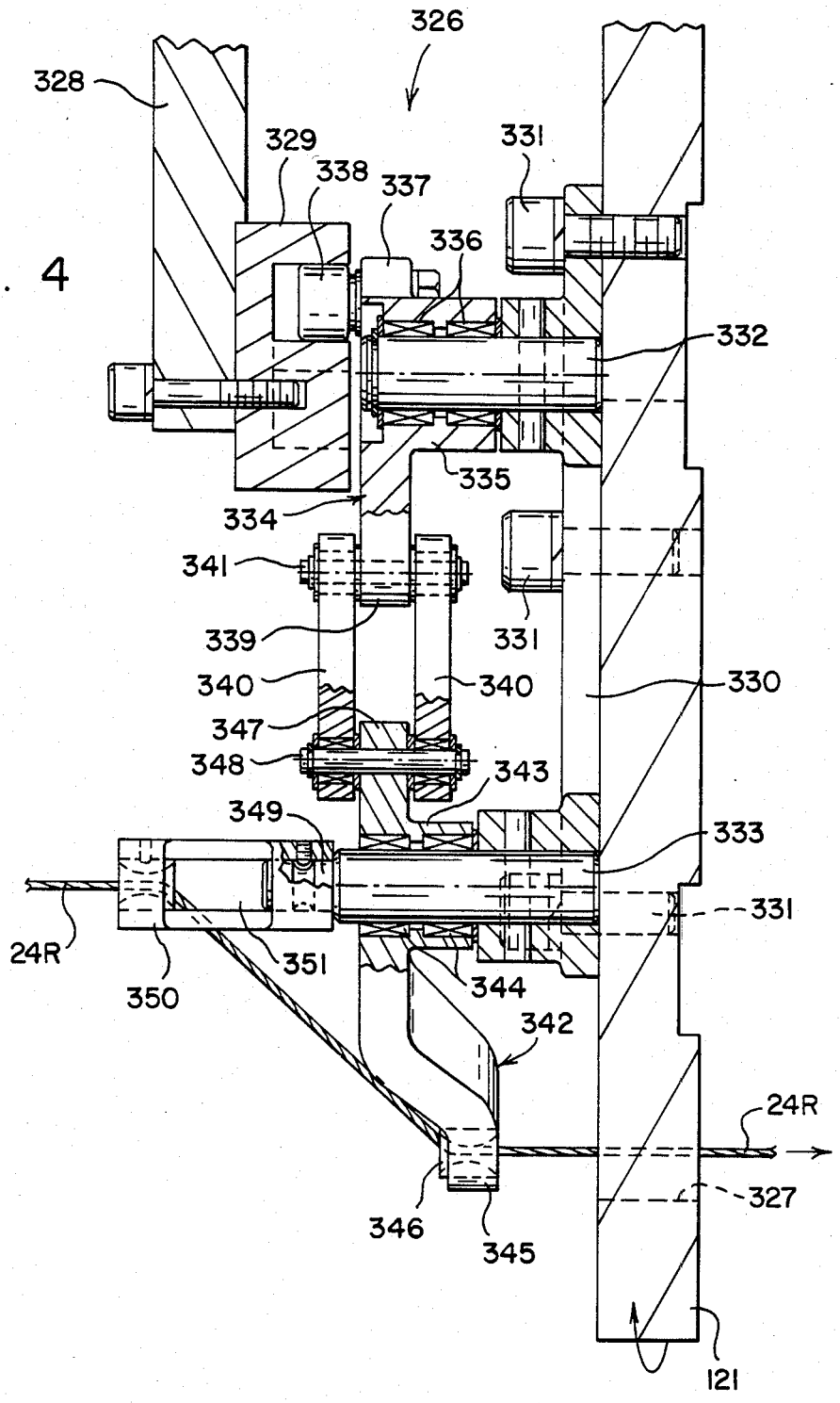
FIG. 4 is a side view, in section, taken substantially as indicated on line 4—4 of FIG. 3, showing details of the apparatus and a mechanism for guiding a moving strand from a rear bobbin through an arc segment relative to the central axis of the braiding machine.

FIGS. 2 and 3 are sequential views looking toward the front of the braiding machine from behind the rear side of the first table 121 which is rotating counterclockwise.

As shown in FIG. 2, the cam follower 338 of the leading strand guide mechanism 326 is outwardly traversing a cam track ramp portion 329T toward a cam track dwell portion 329I. The leading swing arm 342 and an eyelet 346 are guiding a moving strand 24R from a rear bobbin 21R toward the inner end of a first table radially arcuate slot 327. Also as shown, the cam follower 338 of the trailing strand guide mechanism 326 is inwardly traversing a cam track ramp portion 329T toward a cam track dwell portion 329O. The trailing swing arm 342 and an eyelet 346 are guiding a moving strand 24R from a rear bobbin 21R toward the outer end of a radially arcuate slot 327.

As shown in FIG. 3, the cam follower 338 of the leading strand guide mechanism 326 is moving along a cam track dwell portion 329I. A moving strand 24R from a rear bobbin 21R is positioned by the leading swing arm 342 and an eyelet 346 at the inner end of a first table radially arcuate slot 327. Also as shown, the cam follower 338 of the trailing strand guide mechanism 326 is moving along a cam track dwell portion 329O. A moving strand 24R from a rear bobbin 21R is positioned by the trailing swing arm 342 and an eyelet 346 at the outer end of a radially arcuate slot 327.

Figure 6:
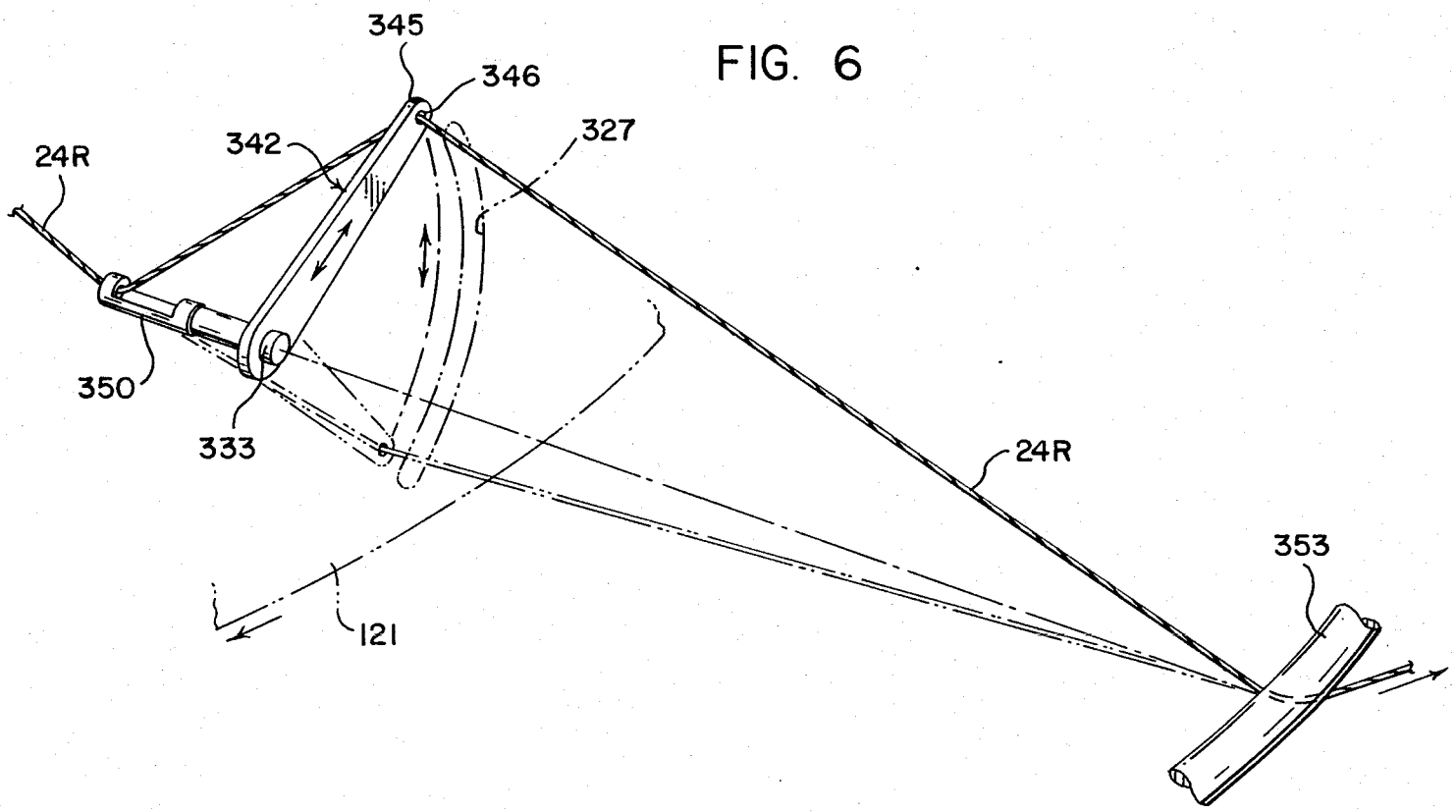
FIG. 6 is a perspective view showing the functions of the apparatus components for guiding a tensioned moving strand from a rear bobbin.

FIG. 6 depicts the linear and arcuate movement of one rear strand 24R moving through a strand guiding eyelet holder 350 and then toward and through a swing arm eyelet 346 and then toward and through a first table radially arcuate slot 327 and then toward and around a segment of a circular braid ring 353. The full line position of the strand 24R is at the inner end of a first table radially arcuate slot 327. The chain line position of the strand 24R is at the outer end of an arcuate slot 327. The chain line extending from the swing arm mounting pin 333 to the braid ring 353 is parallel to the central axis of the braiding machine 120.

FIG. 6 also illustrates an operating efficiency of the strand guide mechanism 326. The swing arm pin 333 functions as a pivot point and the rotational axis of a swing arm 342. A swing arm 342 functions to geometrically position a moving rear strand 24R relative to the moving front strands 24F (not shown in FIG. 6) while maintaining uniform strand tension during interweaving. The resultant tension force of a positioned rear strand 24R is directed from a swing arm terminal end 345 and eyelet 346 through the rotational axis of the swing arm 342, the pivot pin 333. The strand tension force is statically balanced by the reaction force of the pivot pin 333. Therefore, only minimal power is required from the drive mechanism (225) for rotating the first table 121 to initiate and maintain arcuate movement of a swing arm 342 in engagement with a rear strand 24R.

Figure 7:
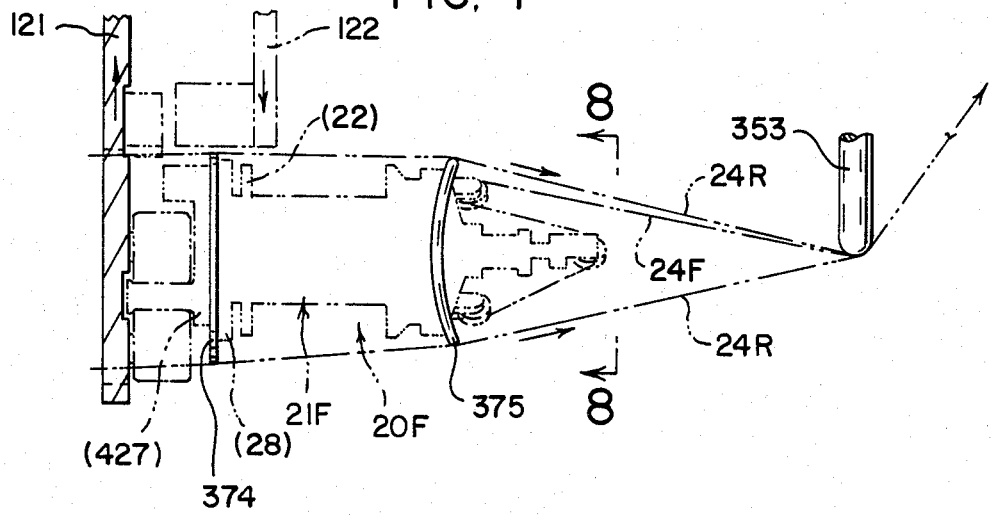
FIG. 7 is a side view showing deflector elements which may be used to guide a moving strand from a rear bobbin relative to the outer dimensions of a front carrier for a strand supply bobbin; and, FIG. 8 is an enlarged front view of a front carrier for a strand supply bobbin, taken substantially as indicated on line 8—8 of FIG. 7.
Figure 8:
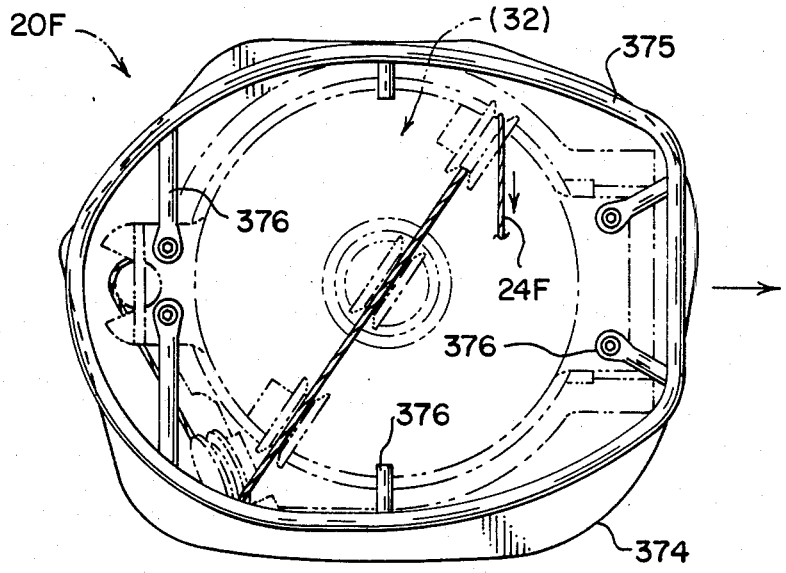

FIGS. 7 and 8 illustrate a modification to a front carrier 20F for a strand supply bobbin which may be required for satisfactory operation of a braiding machine 120 using the strand control apparatus 325 according to the invention. A generally axial alignment of the front and rear carriers, 20F and 20R, will permit the use of strand supply bobbins, 21R and 21F, of a relatively large diameter. The larger the diameter of a bobbin 21, the greater the amount of strand material 24; increasing the operational time of the braiding machine 120 without shutting down for replacement with a full bobbin 21. However, a front carrier 20F suitable for carrying a spool (22) of a large diameter bobbin 21 could momentarily impinge upon a moving rear strand 24R. Such momentary impingement could occur against the base of a carrier 20F when a moving strand 24R is at the inner and outer ends of the first table radially arcuate slot 327. A momentary impingement could also occur against top portions or the front sides of a carrier 20F.

If required by the effective diameter of a front carrier 20F for a front strand supply bobbin 21F, a suitably shaped deflector plate 374 may be positioned between a carrier base member (28) and a carrier mounting shuttle platform (427). Also, a suitably shaped deflector ring 375 may be secured, as by a series of mounting brackets 376, to a raisable cap (32) of a front carrier 20F.

What is claimed is:

1. In a braiding machine having a set of rear carriers for a strand supply bobbin mounted on the rear side of a first table for rotation in one direction, the strands from a set of supply bobbins on said rear carriers passing through a set of peripheral slots in said first table, a second table in front of said first table, a set of front carriers for a strand supply bobbin mounted on and driven around the front side of said first table by rotation of said second table, a central axis stationary shaft for rotatable mounting of said first and second tables thereon, a drive mechanism for rotating said first and second tables in opposite direction, and an apparatus for control of moving strands from the sets of supply bobbins on said rear and front carriers during movement thereof around and along said central axis stationary shaft and toward the "work center" of said braiding machine, said apparatus having a set of said first table peripheral slots which are radially arcuate for movement of a set of strands from said rear carriers through an arc segment relative to the axis of said stationary shaft, said apparatus further comprising: a set of mechanisms carried on the rear side of said first table for guiding a set of strands from said rear carriers prior to movement thereof into said radially arcuate slots, each said rear strand guide mechanism being between two of said radially arcuate slots; a variable radius cam track selectively positioned behind the rear side of said first table and radially inward of said set of rear carriers, said cam track actuating and controlling said set of rear strand guide mechanisms by rotation of said first table; and, a circular braid ring mounted coaxially on said central axis stationary shaft in front of said second table and having an outer diameter substantially coincident with the axes of rotation of a set of bobbins on said front carriers.

2. A braiding machine according to claim 1 wherein, said circular braid ring is rotated in the same direction as the set of supply bobbins on said rear carriers and said first table.

3. A braiding machine according to claim 1 wherein, each said rear strand guide mechanism has an elongated rotatable swing arm movable in a common plane perpendicular to the axis of said central stationary shaft and having an eyelet for engaging a moving strand from one of said rear carrier supply bobbins behind the rear side of said first table.

4. A braiding machine according to claim 3 which further has, a set of strand guide components positioned behind the rear side of said first table at a point along the axis of rotation for said guide mechanism swing arms to receive moving strands from said rear carrier supply bobbins before said moving rear strands are engaged by said swing arm eyelets.

5. A braiding machine according to claim 1 wherein, said variable radius cam track is carried by a control element adjustably positioned coaxially around said central axis stationary shaft behind the rear side of said first table.

6. Apparatus for use on a braiding machine having a set of carriers for a strand supply bobbin mounted on the rear side of a rotatable table having a set of peripheral radially arcuate slots therethrough, another set of carriers for a strand supply bobbin rotatably mounted in front of said table, and a central axis stationary shaft rotatably mounting said table, said apparatus including a control element adjustably positioned coaxially around said central axis stationary shaft behind the rear side of said table, a variable radius cam track carried by said control element radially inwardly of said set of rear carriers, said cam track having a set of alternating inner and outer dwell portions connected by a ramp portion, and a set of strand guide mechanisms, each said strand guide mechanism having: a base plate attached to the rear side of said first table between any two of said radially arcuate slots and carrying a radially inner drive plate pin and a radially outer swing arm pin; a generally triangularly shaped drive plate having a base corner rotatably carried by said drive plate pin, an apex corner carrying a projecting cam follower for confined engagement within said cam track, and a terminal corner; connector means having one end pivotally connected to said drive plate terminal corner; an elongated swing arm having a base end rotatably carried by said swing arm pin, a terminal end carrying an eyelet for engaging a moving strand from one of the supply bobbins on a carrier mounted on the rear side of said table, and a crank arm on said swing arm terminal end pivotally connected to the other end of said connector means; said drive mechanisms being actuated during rotation of said table and the movement of said cam followers within said cam track.

7. Apparatus according to claim 6 wherein each said base plate swing arm pin mounts a strand guiding eyelet holder, said eyelet holder establishing an optimum center point for a moving strand from one of the supply bobbins on a carrier mounted on the rear side of said table and having a side slot for exit of said moving strand toward said swing arm terminal end.

8. In a braiding machine having sets of carriers for a strand supply bobbin mounted for rotation around a central axis stationary shaft, a table mounted for rotation around said shaft in front of said sets of carriers, a drive mechanism for rotating said table in one direction, and a circular braid ring carried by a hub mounted on said stationary shaft in front of said table, an additional drive mechanism for rotation of said braid ring and hub in a direction opposite to the direction of rotation of said table, said braid ring drive mechanism comprising: a lateral arm secured to said hub; a first sprocket positioned around said stationary shaft and connected to the front side of said table; a post shaft extending from the rear side of said lateral arm substantially parallel to said stationary shaft and toward said table; a second sprocket aligned with said first sprocket and positioned around the end of said post shaft and rotatable thereon; a third sprocket positioned around the medial portion of said post shaft and coupled to said second sprocket for rotation thereby; a fourth sprocket positioned around said stationary shaft and coupled thereto and aligned with said third sprocket; a first chain means connecting said first sprocket to said second sprocket; and, a second chain means connecting said third sprocket with said fourth sprocket.

* * * * *